United States Patent [19]

Christensen et al.

[11] 3,949,871

[45] Apr. 13, 1976

[54] PACKAGE TUBE

[75] Inventors: Tom Christensen, Allerod, Denmark; Ove Wendel, Malmo; Carl-Erik Sandstrom, Lund, both of Sweden

[73] Assignee: AB Akerlund & Rausing, Lund, Sweden

[22] Filed: Jan. 7, 1975

[21] Appl. No.: 539,243

[30] Foreign Application Priority Data

Jan. 10, 1974 Sweden ..... 7400286

[52] U.S. Cl. ..... 206/229; 215/1 C; 222/107; 401/202

[51] Int. Cl.[2] .. B43K 9/00; B43K 8/00; B65D 47/42

[58] Field of Search ..... 206/229, 216; 220/23; 215/32, 1 C; 401/132, 202, 196; 222/107, 192, 541, 544

[56] References Cited

UNITED STATES PATENTS

| | | | |
|---|---|---|---|
| 2,718,973 | 9/1955 | Dahl et al. | 220/23 |
| 3,121,906 | 2/1964 | Hulsh | 401/202 |
| 3,781,122 | 12/1973 | Chesseman | 401/202 |
| 3,797,946 | 3/1974 | Witzmann et al. | 401/196 |
| 3,858,739 | 1/1975 | Turner et al. | 222/541 |

*Primary Examiner*—William T. Dixson, Jr.
*Attorney, Agent, or Firm*—Pierce, Scheffler & Parker

[57] ABSTRACT

The package tube according to the invention is characterized in that its closing means has at least one portion having a larger dimension than the hole in a spreading sponge or the like thrust on the tube neck.

6 Claims, 14 Drawing Figures

PACKAGE TUBE

This invention relates to a package tube including a tube body, a tube neck and a closing means made integrally with the neck and closing the discharge opening thereof.

The tube according to the invention is characterized in that said closing means has at least one portion having a larger dimension than the hole in a spreading sponge or the like thrust on the tube neck.

Preferably, said closing means further has a step or the like faced towards the tube body, over which step a protecting cover provided with a bore may be drawn. The step may then hold this protecting cover by forcing the cover bore beyond the step. Owing to this, the protecting cover will thoroughly cover the spreading sponge being totally encased between the protecting cover and the tube body. THe protective cover, however, may of course be held in other ways, for instance by means of ribs, notches or the like.

At first hand, the tube according to the invention is adapted to be used as a single-dose one-way package for medicine or the like. It is, however, obvious for a man skilled in the art, that of course the tube can be used for other products and also as a multiple-dose package and herewith provide it with a simple re-closing means. The greatest advantages, however, are obtained when using it as a single-dose package. In such a case it is possible to see directly on a finished filled package whether it is used or not. At the same time, it is, when required, possible to see to it that the spreading sponge is completely protected by said protecting cover. If the tube is used without this protecting cover, some other protection is required, for instance a plastic bag or the like.

In the following the invention is described more in detail with reference to the accompanying drawings, which illustrate a preferred embodiment of the invention subject.

Figure 14:
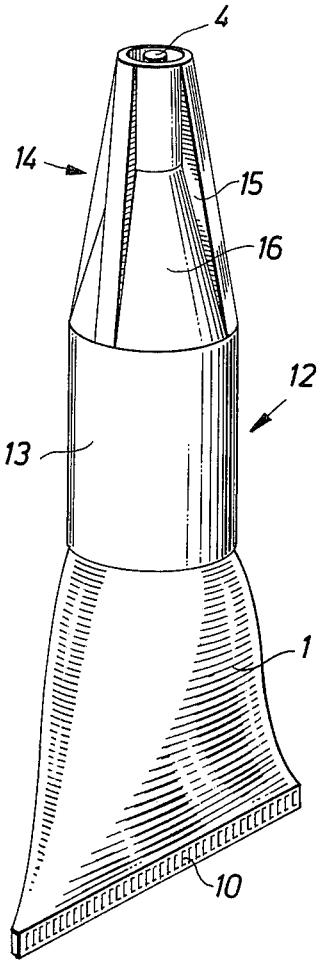

FIG. 14, finally, also shows the tube provided with a protecting cover, however here provided with a somewhat different locking means for the protecting cover.

The tube according to the invention consists of a tube body 1, a tube neck 2 and a closing means 3. This closing means is made integrally with the tube neck 2 and encloses the discharge opening of the tube neck. The closing means has an outer point 4 which merges into a conical portion 5. In the embodiment shown, this conical portion 5 has a circular cross section and merges in its turn into a conical portion 6 having an oval cross section. The two conical portions 5 and 6 form steps 7 and 8 faced towards the tube body 1. The purposes of these steps are described below. Between the closing means 3 and the tube neck 2 is a weakened portion 9 which renders a breaking or shearing off of the closing means 3 possible in order to open the tube.

FIGS. 5–8 show the tube according to FIGS. 1–4 in a filled and sealed state. The bottom seal is designated with the reference numeral 10. The other reference numerals in FIGS. 5–8 are the same as those in FIGS. 1–4 and refer to the same details.

The tube shown can be manufactured in different ways. For instance, it can be manufactured by injection moulding in one piece. Alternatively, it is possible to extrude a tube-shaped part forming the tube body and on this part injection mould a tube neck and closing means formed in one piece. Finally, the tube can be manufactured by a combination of blow moulding and injection moulding. In all said manufacturing methods the closing means can be formed by the casting jet.

Figure 9:
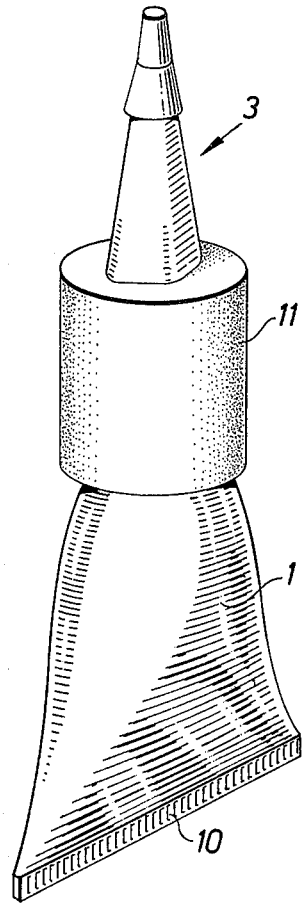
FIG. 9 shows the same tube but now provided with spreading sponge.

FIG. 9 shows the filled and sealed tube according to FIGS. 5–8 provided with a spreading sponge 11. This sponge can be made of foamed rubber or some corresponding synthetic plastic material and is held in place on the tube neck 2 by the step 8 as best shown in FIG. 9.

Figure 1:
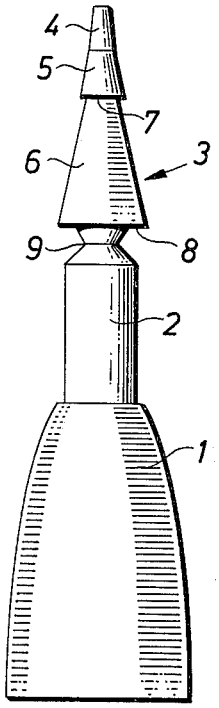
FIGS. 1–3 show a tube according to the invention in three views perpendicular relative to each other, before the tube has been provided with a spreading sponge and before the tube has been filled and sealed.
Figure 2:
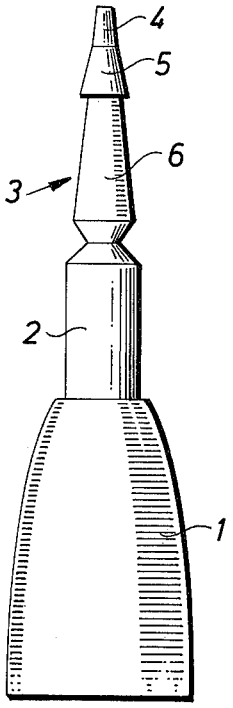
Figure 4:
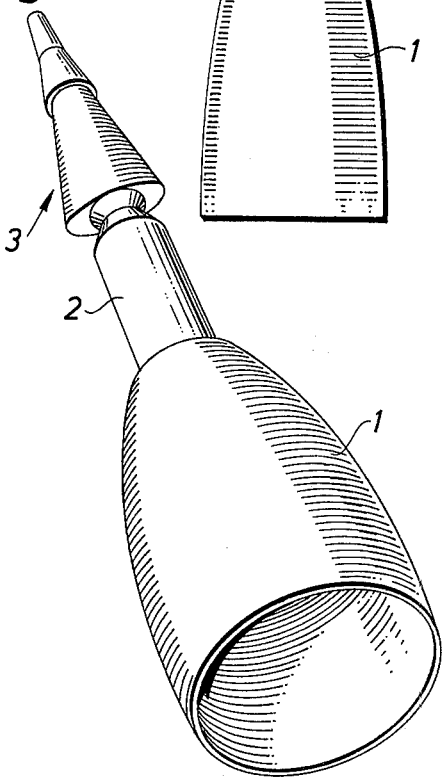
FIG. 4 shows a perspective view of the same tube.
Figure 3:
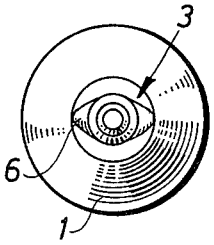
Figure 5:
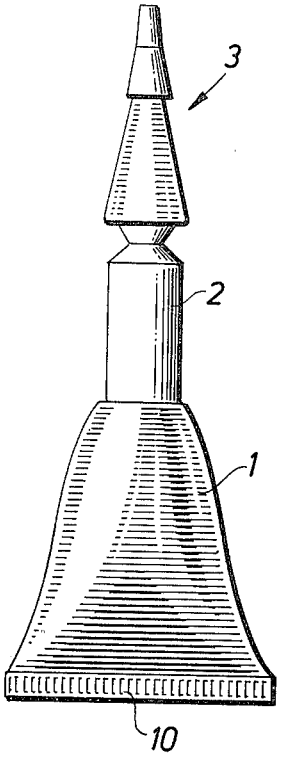
FIGS. 5–8 show in the same manner four views of the tube after it has been filled with the product, also before the tube has been provided with a spreading sponge.
Figure 6:
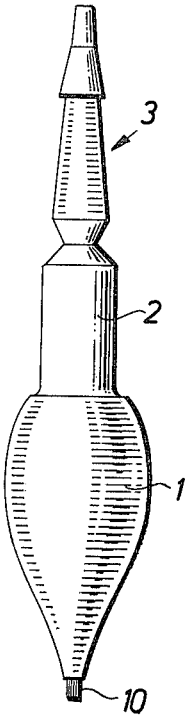
Figure 8:
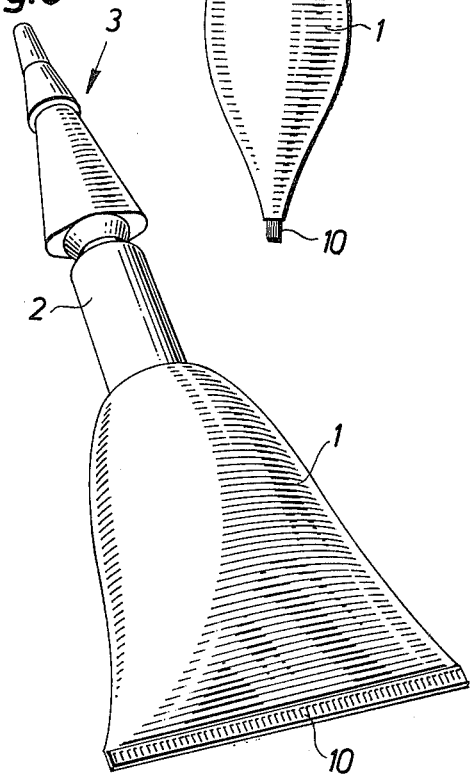
Figure 7:
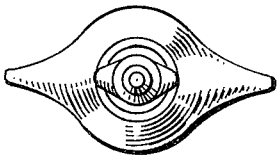
Figure 10:
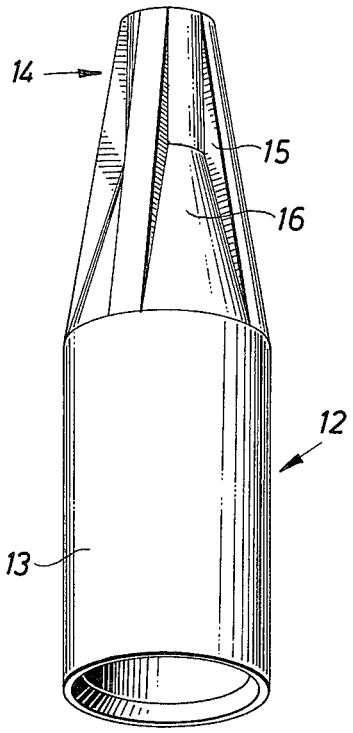
FIGS. 10, 11 and 12 show a protecting cover in a perspective view and opposite end views, respectively.
Figure 12:
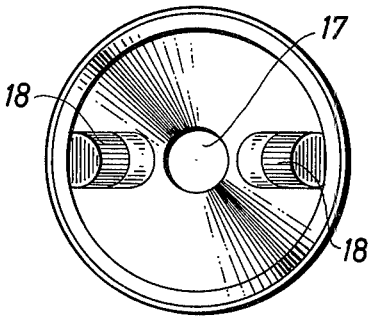
Figure 11:
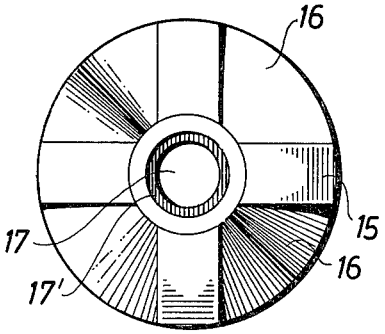

If the tube according to the invention shall be used for medical purposes, the spreading sponge 11 must be protected from extraneous contact. This can be done in such a simple way that the tube provided with the spreading sponge is envelopped in a plastic bag or the like. More appropriate, however, is to provide the tube with a protecting cover as shown in FIGS. 10–12. In this respect, FIG. 10 shows the protecting cover in a perspective view, while FIG. 11 shows the cover seen from above and FIG. 12 shows the cover seen from below. In the embodiment shown, the cover 12 consists of a cylindrical portion 13 and an upper conical portion 14, the latter being provided with ridges 15 or the like forming recessed portions 16 therebetween. The cover is at its upper end provided with a bore 17. This bore 17 has a somewhat smaller diameter than the largest diameter of the conical portion 5 of the closing means 3 (cp. FIG. 1). Owing to this, the cover 12 can be pressed over this conical portion 5 and be locked against the step 7 formed by the bottom side of this portion. The cover 12 is internally provided with recesses 18 fitting to the oval conical portion 6 of the closing means 3. Owing to this, the cover 12 can be locked against rotation relative to the closing means 3 after that it has been pressed over the closing means and been placed to protect the spreading sponge 11. To be able to open the tube the cover must accordingly be rotated and in doing this the cover shears off the closing means 3. This is facilitated by the fact that the cover has been provided with the ridges 15 and the recessed portions 16 therebetween.

Figure 13:
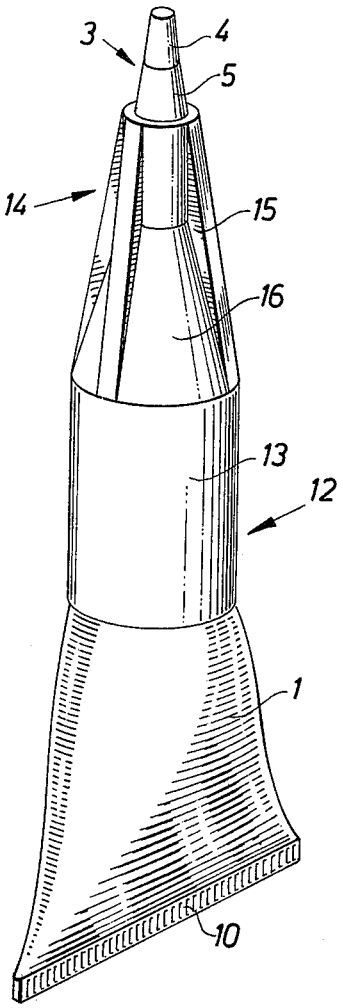
FIG. 13 shows the tube provided with a protecting cover according to FIGS. 10–12.

FIG. 13 shows the cover 12 according to FIGS. 10–12 pressed on a tube provided with a spreading sponge, i.e. in the form the tube normally has when handed over to the user.

FIG. 14, finally, shows an alternative fastening of the protecting cover 12. This fastening has been obtained by placing the step 17′ shown in FIG. 11 deeper in the hole 17 compared with the embodiment shown in FIG. 13. By having such a deeper location of the step 17′ substantially the whole closing means 3 becomes accordingly hidden within the protecting cover 12.

The invention is of course not only limited to the embodiment being described above, but can be varied within the frame of the following claims. For example, the shape of the tube body can be varied. It may for instance be shaped either more like a bottle or more like a cushion package. Also the closing means and the cover may be varied as to shape. If desired, also the neck portion 2 of the tube can be provided with ridges or the like in order to prevent the spreading sponge 11 to be rotated out of its position.

We claim:

1. A package tube comprising a tube body, a tube neck integral therewith and extending therefrom and provided with a discharge passage therein, a closing means formed integrally with said tube neck and connected thereto by a weakened portion for closing the discharge passage in said tube neck, the inner end portion of said closing means having a greater outer dimension than said tube neck, said closing means also being provided with an offset portion facing said tube body, a sponge-like body mounted on said tube neck, and a protecting cover member provided with a passage therethrough, said passage having an enlarged portion at the inner end thereof for enclosing and protecting said sponge-like body and said cover member being provided with a recess for engaging the offset portion of said closing means for retaining the cover member in place.

2. A package tube as claimed in claim 1 wherein the outer surface of said closing means and the inner surface of said protecting cover member form non-circular mating surfaces whereby rotation of said cover member relative to said tube body will cause said closing means to be sheared from said tube neck at the weakened portion thereof to open said package tube.

3. A package tube as claimed in claim 1 wherein said cover member sealingly presses against said tube body when said cover member engages the offset portion of said closing means.

4. A package tube as claimed in claim 2, wherein said cover member is further provided on its outer surface with gripping means to facilitate rotation of said cover member when opening said package tube.

5. A package tube as claimed in claim 1 wherein the outer end of said closing means is conical with the largest dimension facing said tube body to form said offset portion of said closing means, said dimension being greater than the corresponding dimension of the passage through said cover member.

6. A package tube as claimed in claim 2 wherein the mating surfaces are conical each having an oval cross-section to prevent relative rotation between said cover member and said closing means.

* * * * *